United States Patent [19]

Roccaforte

[11] 4,201,294

[45] May 6, 1980

[54] HAND LOCKED DISPLAY CARTON AND BLANK THEREFORE

[75] Inventor: Harry I. Roccaforte, Western Springs, Ill.

[73] Assignee: Champion International Corporation, Stamford, Conn.

[21] Appl. No.: 36,373

[22] Filed: May 7, 1979

[51] Int. Cl.[2] ..... B65D 75/02; B65D 65/16

[52] U.S. Cl. ..... 206/45.14; 206/45.31; 206/485; 248/152; 229/40

[58] Field of Search ..... 206/485, 486, 487, 45.14, 206/45.19, 45.31, 434; 229/40; 248/152, 134; 211/73

[56] References Cited

U.S. PATENT DOCUMENTS

| | | | |
|---|---|---|---|
| 2,229,427 | 1/1941 | Tanner | 206/45.14 |
| 3,023,759 | 5/1977 | Perkins | 211/73 |
| 3,157,275 | 11/1964 | Tolaas | 206/45.14 |
| 3,185,292 | 5/1965 | Maro | 206/45.14 |
| 3,239,177 | 3/1966 | Samsing | 248/152 |

*Primary Examiner*—William T. Dixson, Jr.
*Attorney, Agent, or Firm*—Evelyn M. Sommer

[57] ABSTRACT

A display carton for an elongated bottle is formed from a single blank and includes an upper display panel for advertising, and is wrapped about the length of the bottle to completely expose two opposed sides thereof. The carton is manually secured along the base thereof by an arrangement of bendable flanges pivotally connected to an outer base panel in cooperation with locking flanges disposed on an inner base panel. The bendable flanges are disposed perpendicular to the carton base and are generally arcuate in shape resulting in an interference fit between the bendable flanges and the inner surfaces of the carton, thus keeping the flanges in an upright, locked position, for maintaining the carton in a closed condition. The display carton includes apertures for engaging the top and bottom portions of the bottle therein, to prevent lateral shifting of the bottle within the carton, thus affording protection to the bottle during shipment and display.

22 Claims, 8 Drawing Figures

HAND LOCKED DISPLAY CARTON AND BLANK THEREFORE

The subject invention relates to a new and improved display carton and blank for making same, and more particularly, to a display carton which is adapted to accommodate an elongated bottle where the length and width of the display carton is greater than the length and width of the bottle and cap portion. The carton is hand loaded and closed by bendable flanges, and requires no additional heat sealing or gluing by the loader. The subject invention affords an unobstructed view of two opposed sides of the bottle therein, and restrains the bottle from movement within the carton, thus keeping the bottle safe during shipment and storage.

The prior art includes display cartons which require heat sealing or gluing of the container after the bottle is placed inside the container. Where hand loading of the prior art carton is desirable, as in short run situations, manually applying the glue strip or heat sealing can be difficult and time consuming.

Accordingly, it is an object of the subject invention to obviate the shortcomings of the prior art carton by providing a hand locked carton, which is closed manually by the use of locking tabs or flanges formed integral with the carton.

It is a further object of the subject invention to provide a carton which in addition to being hand locked will afford maximum visibility of the bottle therein while also providing for sufficient advertising display areas.

It is still a further object of the subject invention to provide a hand locked carton which keeps the bottle therein safe during shipment and storage.

To achieve these objectives, the display carton is hand locked by means of bendable flanges attached to the bottom of the carton so that no heat sealing or gluing is necessary. Further, the subject display carton is provided with large display areas created by having the display carton of greater length and width than the length and width of the bottle and cap portion thereof. In addition, the subject display carton encloses only the front and rear of the bottle thus allowing for an unobstructed view of the sides of the bottle. To prevent shifting of the bottle within the carton, the subject invention is provided with restraining means adjacent the top and bottom of the display carton. More particularly, the subject invention is a display carton and a blank for making same, wherein the carton includes a pair of upper display panels intended to be adhesively attached to each other in a pregluing step by the container manufacturer. The upper display panels are hingedly attached to two inclined panels. The inclined panels are provided, as required, with two upper apertures adapted to engage the cap portion of the bottle to prevent lateral movement of the upper portion of the bottle. Two main display panels which are hingedly attached to the inclined panels are provided, with the inner surface of each main display panel respectively abutting the front and rear sides of the bottle. The lower support panels are hingedly connected to the main display panel and have apertures therein such that the lower portions of the front and rear sides of the bottle project through and are engaged in the apertures, to aid in preventing lateral movement of the lower end of the bottle. An inner bottom panel is hingedly connected to one of the lower support panels and includes arcuate flanges aligned beneath the apertures in the lower support panels such that the arcuate flanges support the bottom of the bottle where it projects through the apertures in the lower support panels. The inner bottom panel further includes two locking flanges forming a part of the closure structure. The rest of the closure structure is provided on an outer bottom panel disposed below the inner bottom panel. The outer bottom panel has two generally rectangular flanges disposed upright and generally perpendicular from the outer bottom panel. The ends of the flanges are bent inwardly towards the center of the carton, thus giving the flanges a generally arcuate configuration. The locking flanges of the inner bottom panel engage the rectangular flanges along locking cut lines provided along one edge of the rectangular flanges. The positive locking arrangement between the locking flanges and the locking cut lines, in addition to the arcuate configuration given to the rectangular flanges, which results in an interference fit between a lower support panel and the edge of the rectangular flange opposite the locking cut line, maintains the rectangular flanges in an upright position for providing a firm and stable closure of the carton.

An additional advantage of the subject display carton is that the closure, since it is not glued or heat sealed, can be readily disassembled, if necessary, and then reassembled again. Thus, if errors are made during loading they can be corrected without having to discard the display carton.

Further objects and advantages of the subject invention will become apparent from the following detailed description taken in conjunction with the drawings in which:

FIG. 1 is a plan view of the blank of the subject invention which is adapted to be erected into a display carton of the subject invention, such as shown in FIGS. 2–5;

FIGS. 2–4 sequentially illustrate manual loading of a bottle in the display carton of the subject invention;

Figure 1:
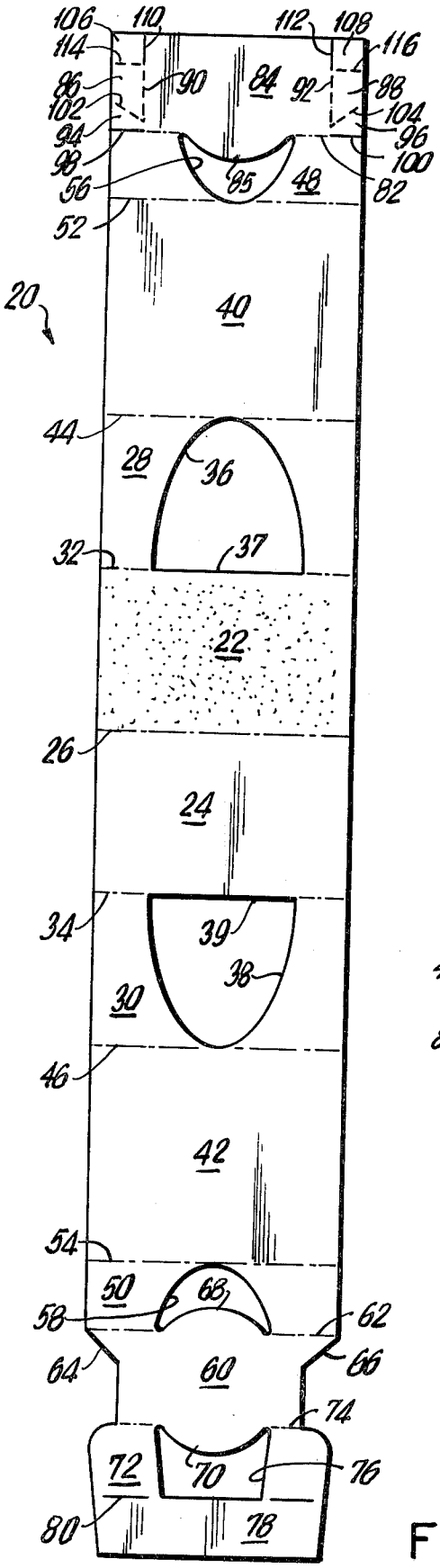

Referring to FIGS. 2–5, a first embodiment of the display carton of the subject invention is designated generally by the number 10 and is intended for use in the shipping and displaying of a bottle 12 which must be attractively packaged and yet protected during shipment and storage. Bottle 12 includes a cap portion 14 and a base portion 16. The width of the display carbon 10, designated by the letter "W" (see FIG. 5), is greater than the width "X" of the bottle. The depth of the display carton 10 (see FIG. 4), substantially corresponds to the depth of the bottle 12.

Display carton 10, erected from a foldable blank 20 (see FIG. 1) is preferably made of a foldable paperboard or similar sheetlike material. Blank 20 includes two upper display panels 22 and 24, generally rectangular in configuration and hingedly connected to each other along fold line 26. Inclined panels 28 and 30 are respectively hingedly attached along fold lines 32 and 34 to each end of the upper display panels 22 and 24. In the first embodiment the inclined panels 28 and 30 have semi-elliptical upper apertures 36 and 38, with the base lines 37 and 39 of the apertures being disposed adjacent the upper display panels 22 and 24. The base lines 37 and 39 have a length substantially corresponding to the diameter of the cap portion 14 of the bottle so that the cap portion will fit snugly into the upper apertures 36 and 38. Main display panels 40 and 42 are respectively hingedly attached to the inclined panels 28 and 30 along fold lines 44 and 46. First and second lower support panels 48 and 50 are hingedly attached to the main display panels 40 and 42 along fold lines 52 and 54. The lower support panels 48 and 50 include lower apertures 56 and 58 for engaging the lower portions of the bottle. In this embodiment the lower apertures 56, 58 are crescent shaped. An inner bottom panel 60 is hingedly attached to the second lower support panel 50 along fold line 62. The inner bottom panel 60 has locking flanges 64 and 66 disposed adjacent the second lower support panel 50 which are part of the closure structure, as more fully described hereinafter. The inner bottom panel further includes two arcuate flanges 68 and 70. A first inner support panel 72 is hingedly attached to the inner bottom panel 60 along the fold line 74, and includes a locking aperture 76 substantially corresponding to the configuration of lower aperture 56 in the lower support panel 48. A second inner support panel 78 is hingedly connected to the first inner support panel 72 along fold line 80.

An outer bottom panel 84 is hingedly connected along fold line 82 to the first lower support panel 48, and includes an arcuate flange 85, disposed adjacent the first lower support panel 48. Rectangular flanges 86 and 88 are hingedly connected to the outer bottom panel 84 along perforated fold lines 90 and 92 extending generally orthogonal to fold line 82. The rectangular flanges 86 and 88 include two triangular sections 94 and 96 disposed adjacent to the first lower support panel 48. The sides of the triangular sections 94 and 96 are defined by the edge of the flange, and perforated fold lines 102 and 104 extending at approximately a 45° angle from the edge. The third side of each triangular section is defined by a cut line, 98 and 100 extending from the edge of the rectangular flange along the fold line 82 and terminating at the outer bottom panel 84. The rectangular flanges 86 and 88 further include two generally square sections 106 and 108 disposed on the edge of the flange opposed to the triangular sections 94 and 96. The generally square sections 106 and 108 are defined on two sides by the corner edges of the rectangular flanges. A third side of each generally square section, 106 and 108, is defined by perforated fold lines 114, 116 extending generally orthogonal between the outer edge of the flanges and the fold lines 90 and 92, respectively. The fourth side of each generally square section 106, 108 is defined by cut lines 110 and 112 extending orthogonally between the termination of the perforated fold lines 114 and 116, and the edge of the blank 20. The rectangular flanges 86 and 88 are bent upwards to lock the carton in a closed position as more fully described hereinafter.

Figure 2:
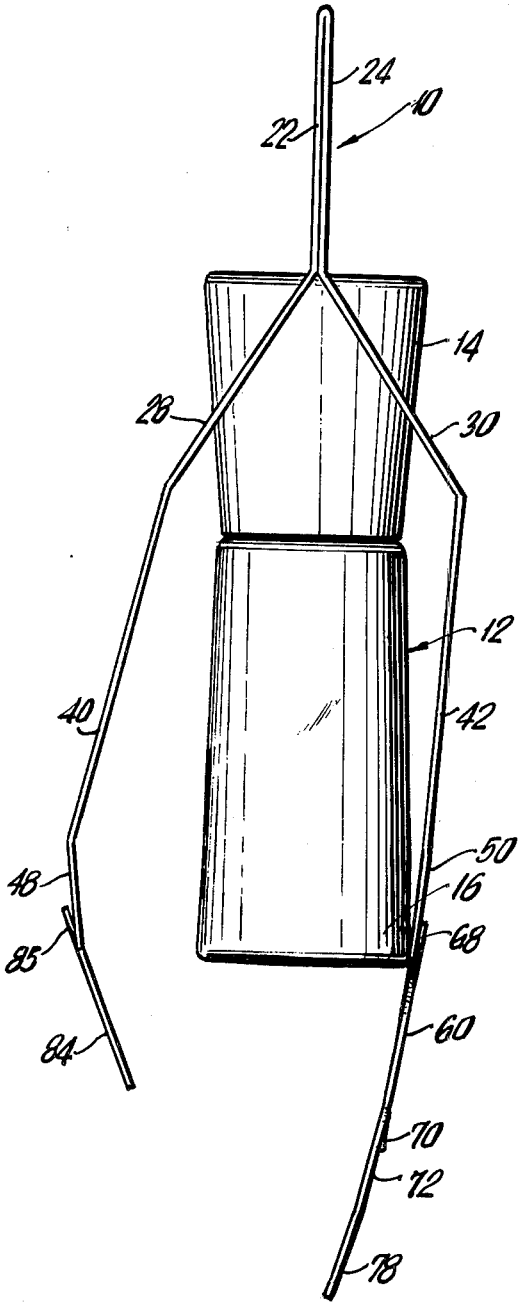

The upper display panels 22 and 24 are intended to be preglued by the carton manufacturer. As illustrated in FIG. 2, the bottle is hand loaded into the carton with the cap portion shown generally at 14, inserted into the semi-elliptical upper apertures 36 and 38 which are adapted to receive the cap portion 14 of the bottle. The engagement of the cap portion 14 in the upper apertures 36 and 38 aids in preventing shifting of the upper portions of the bottle within the carton.

Figure 3:
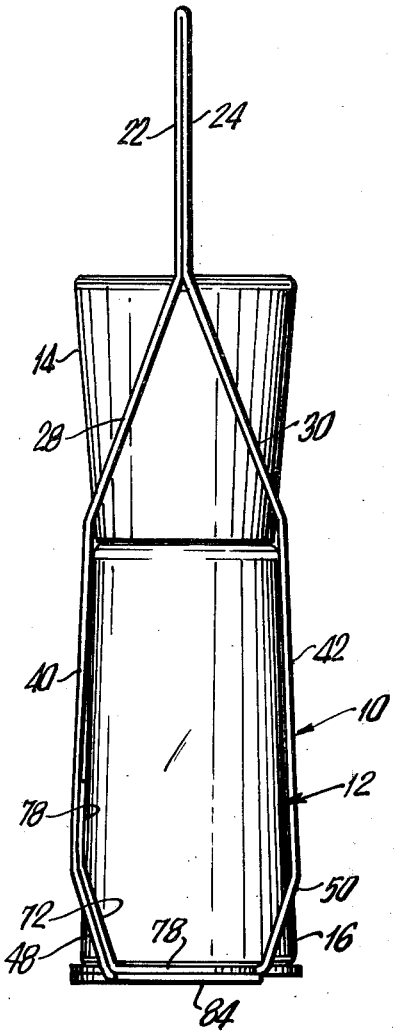

In the next loading step, the bottom panels are wrapped around the bottom of the bottle. As illustrated in FIG. 3, the second lower support panel 50 is bent along fold line 54 such that the bottom edge of the bottle 16 projects through the lower aperture 58. The inner bottom panel 60 is bent along fold line 62 so that the inner surface of the inner bottom panel abuts the bottom of the bottle. Then, the first inner support panel 72 is bent upwards along fold line 74, such that the opposed bottom edge of the bottle 16 projects through the locking aperture 76 in the first inner support panel 72. The second inner support panel 78 is bent along fold line 80 such that the inner surface of the panel abuts the side of the bottle. The inner support panels 72 and 78 function to add structural rigidity to the erected carton.

The first lower support panel 48 is then bent along fold line 52 such that the lower portion of the bottle, which projects through the lower aperture 76 of the first inner support panel 72, projects through the aligned aperture 56 in the first lower support panel 48. The outer bottom panel 84 is then bent along fold line 82 such that the inner surface of the outer bottom panel 84 abuts the bottom surface of the inner bottom panel 60.

The arrangement whereby the edges near the bottom of the bottle project through the apertures 56, 58 and 76, of the first lower support panel 48, second lower support panel 50 and first inner support panel 72, respectively, prevents shifting of the lower portion of the bottle within the carton. Beneath these apertures, the display carton is provided with arcuate flanges 68 and 70 of the inner bottom panel 60 that are aligned under the apertures 56, 58 and 76, such that the flanges support the portions of the bottom of the bottle which project through the apertures. An arcuate flange 85 of the outer bottom panel 84 is provided and is aligned directly beneath the arcuate flange 70 of the inner bottom panel 60, thus reinforcing the support given the bottom of the bottle by the arcuate flange 70. The closure of the bottom panels draws the main display panels 40 and 42 into abutting relationship with the bottle, which also aids in preventing shifting of the bottle 14 within the erected carton 10.

Figure 4:
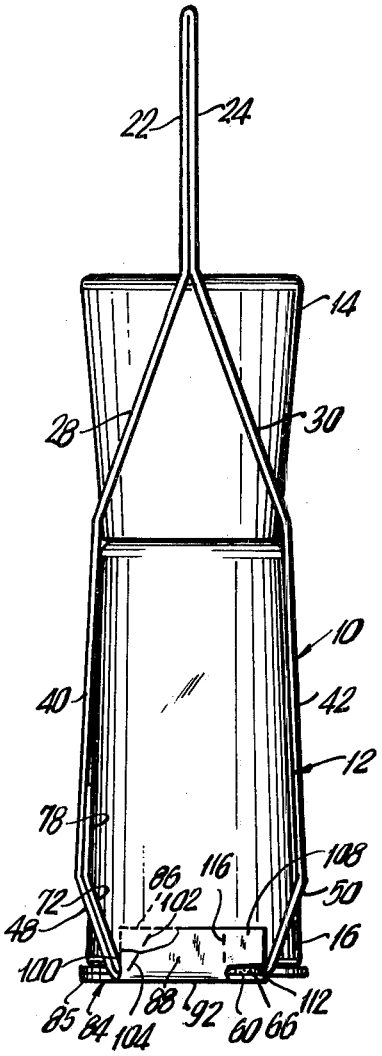

FIG. 4 illustrates the next step in the erection of the display carton 10. The rectangular flanges 86 and 88 are bent upright and are generally perpendicular to the outer bottom panel 84 along fold lines 110 and 112. The locking flanges 64 and 66 of the inner bottom panel 60 engage the rectangular flanges along locking cut lines 110 and 112 adjacent the generally square sections 106 and 108 of the rectangular flanges 86 and 88. This arrangement maintains the flanges in an upright position and effectively closes the carton.

Figure 5:
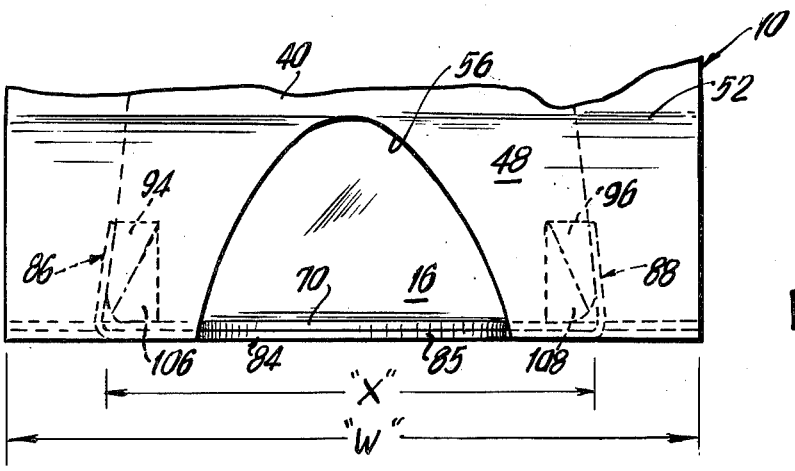
FIG. 5 is a partial sectional view of the lower portion of the subject display carton illustrating the final locked position of the arcuate rectangular flanges.

As viewed in FIG. 5, the triangular sections 94 and 96, and the generally square sections 106 and 108 of the rectangular flanges 86 and 88 are bent inwardly, giving each of the rectangular flanges 86 and 88 a generally arcuate configuration. The arcuate configuration of the rectangular flanges 86 and 88 results in an interference fit between the triangular sections 94 and 96 and the first inner support panel 72 and this aids in maintaining the rectangular flanges in their upright position, giving the carton a solid and sturdy closure.

Figure 6:
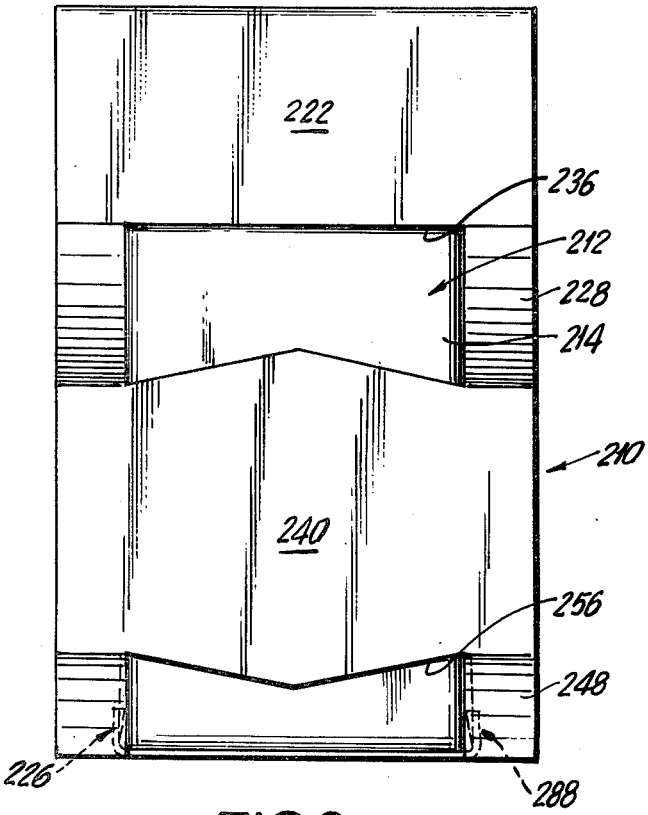
FIG. 6 is a front sectional view of a second embodiment of the display carton of the subject invention.
Figure 7:
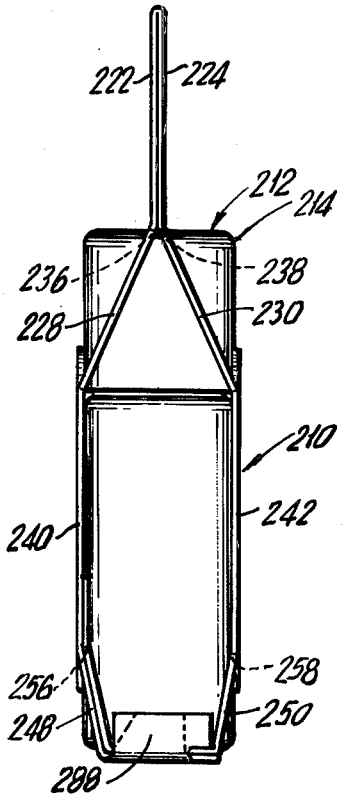
FIG. 7 is a side view of the display carton illustrated in FIG. 6.

A second embodiment of the subject invention adapted for displaying a bottle 212 which is of generally rectangular plan form, as well as being of generally rectangular cross-section, is illustrated in FIGS. 6 and 7. The upper apertures 236 and 238 in the inclined panels 228 and 230 are shaped to substantially conform to the top portion 214 of the bottle 212. Similarly, the lower apertures 256 and 258 in the lower support panels 248 and 250 are shaped to substantially conform to the configuration of the bottom portion of the bottle 212. Thus, as illustrated in FIG. 7, portions of the bottle 212 project through and are engaged in the upper and lower apertures 236, 238, 256 and 258 which thereby inhibits lateral movement of the bottle within the carton during shipment and display. Upper panels 222, 224 and main display panels 240, 242 are provided as in the first embodiment affording adequate display areas for graphics. In addition, rectangular flanges 286 and 288 are provided for closure of the carton 210.

Figure 8:
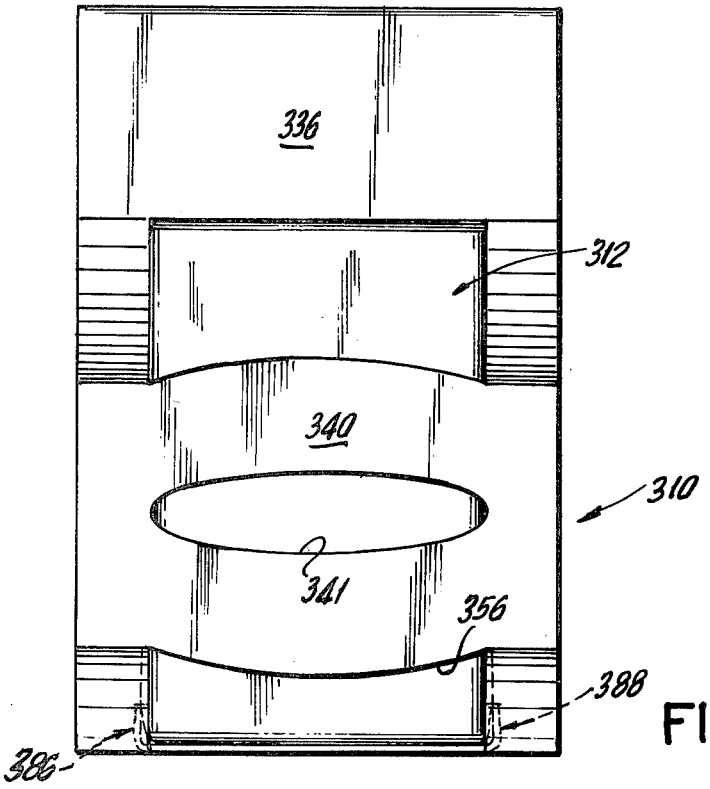
FIG. 8 is a front sectional view of a third embodiment of the display carton of the subject invention.

A third embodiment of the display carton of the subject invention is illustrated in FIG. 8. As in the second embodiment, the upper and lower apertures 336 and 356 are adapted to receive portions of a rectangular bottle 312, while additionally exposing an increased area of the container 312 for viewing. The main display panel 340 is also provided with an aperture 341 affording increased viewing of the container 312 therein. Rectangular flanges 386 and 388 are provided for closure of the carton 310.

Accordingly, there is provided a new and improved display carbon and a blank for forming same, which carton is adapted to accommodate an elongated bottle. The display carton of the subject invention is closed by use of a new and improved locking means consisting of bendable flanges connected to the bottom of the carton. No heat sealing or additional gluing is necessary by the loader, and the closure can be disassembled and reclosed when necessary. Additionally, the carton affords an unobstructed view of two opposed sides of the bottle, while providing sufficient display areas. Further, for the protection of the bottle during shipment and storage, the hand locked display carton includes upper and lower apertures adapted to receive portions of the top and bottom of the bottle for restraining the bottle within the carton.

The present invention has been described in the above specification with reference to a specific embodiments, and such references have been made for purely illustrative purposes and various modifications in the details included therein may be made without departing from the scope or spirit of the invention as will be obvious to those skilled in the art.

What is claimed is:

1. A hand locked display carton for an elongated bottle having at one end a cap, while the other end thereof is a closed base portion, wherein the width and length of the carton are of greater width and length than the bottle and cap portion, with said carton providing an unobstructed view of two opposed sides of the bottle, said carton comprising:

an upper display panel;

two inclined panels hingedly connected to said upper display panel, each inclined panel including an upper aperture therein which substantially corresponds to the configuration of said cap portion of the bottle such that the cap portion of said bottle is engaged in said upper apertures to prevent lateral movement of the cap of the bottle within said carton;

two main display panels respectively hingedly connected to the two inclined panels, with the inner surfaces of said main display panels abutting the front and rear sides of said bottle, said front and rear sides of said bottle being orthogonal relative to the exposed opposed sides of the bottle;

first and second lower support panels hingedly connected to the main display panels, each of said lower support panels having a lower aperture therein such that the lower portions of the front and rear sides of said bottle project through and are engaged in said lower apertures to prevent lateral movement of the lower end of said bottle within said carton;

an inner bottom panel, hingedly connected to the second lower support panel, the upper surface of said inner bottom panel abutting the bottom of the bottle, said inner bottom panel including two locking flanges disposed adjacent the second lower support panel; and a generally rectangular outer bottom panel hingedly connected along one side thereof to the first lower support panel and disposed directly beneath said inner bottom panel, said outer bottom panel including two generally rectangular flanges hingedly connected along the other opposed side edges thereof, with the hinge connection, between each said generally rectangular flange and the outer bottom panel, extending perpendicularly from the hinge line disposed between the first lower support panel and the outer bottom panel to a point intermediate the length of the outer bottom panel, with the remaining distance along said perpendicular line defining a locking cut line, said generally rectangular flanges being disposed upright and generally perpendicular relative to said outer bottom panel such that said locking flanges engage said rectangular flanges along the locking cut lines thereby locking the carton in the closed position.

2. A display carton as in claim 1 wherein said upper display panel is formed of two generally rectangular pieces adhesively bonded to each other.

3. A display carton as in claim 1 wherein each upper aperture in said inclined panels is of generally semielliptical configuration having a curved portion and a base line, with the base line being disposed adjacent said upper display panel, and wherein each lower aperture in said lower support panels is of generally semi-elliptical configuration having a curved portion and a base line, with the base line being disposed adjacent said inner bottom panel.

4. A display carton as in claim 1 wherein said upper and lower apertures are generally rectangular in configuration.

5. A display carton as in claim 1 further including a first inner support panel hingedly attached to the inner bottom panel and disposed within said carton, the outer surface of said first inner support panel abutting the inner surface of the second lower support panel, said first inner support panel having a locking aperture whose configuration substantially corresponds to the aperture in the second lower support panel, said locking aperture being in register with the aperture in the second lower support panel.

6. A display carton as in claim 5 further including a second inner support panel, hingedly attached to said first inner support panel and disposed within said carton, the inner surface of said second inner support panel abutting the bottle while the opposed surface thereof abuts the inner surface of a main display panel.

7. A display carton as in claim 1 wherein each rectangular flange of said bottom panel is divided into sections by perforated lines, said sections including a generally triangular section at one edge of each flange adjacent the first lower support panel and a generally square section at the opposed edge of each flange adjacent the second lower support panel.

8. A display carton as in claim 1 wherein the ends of said rectangular flanges are bent inwardly towards the center of the carton, each flange having an arcuate configuration for aiding in maintaining the flange in an upright position for securely locking the carton.

9. A display carton as in claim 1 wherein said inner bottom panel has two arcuate flanges disposed beneath the apertures in the lower support panels, which arcuate flanges support the bottom of the bottle where the front and rear sides of said bottle project through the apertures of the lower support panels.

10. A display carton as in claim 9 wherein said outer bottom panel has a supporting arcuate flange, adjacent the first lower support panel, disposed beneath and aligned with an arcuate flange of said inner bottom panel, thereby reinforcing said arcuate flange of the inner bottom panel.

11. A hand locked display carton for an elongated bottle having at one end a cap, while the other end thereof is a closed base portion, wherein the width and length of the carton are of greater width and length than the bottle and cap portion. With said carton providing an unobstructed view of two opposed sides of the bottle, said carton comprising:

an upper display panel;

two inclined panels hingedly connected to said upper display panel, each inclined panel including an upper aperture therein, which substantially corresponds to the configuration of said cap portion of the bottle such that the cap portion of said bottle is engaged in said upper apertures to prevent lateral movement of the cap of the bottle within said carton;

two main display panels respectively hingedly connected to the two inclined panels, with the inner surfaces of said main display panels abutting the front and rear sides of said bottle, said front and rear sides of said bottle being orthogonal relative to the exposed opposed sides of the bottle;

first and second lower support panels hingedly connected to the main display panels, each of said lower support panels having a lower aperture therein such that the lower portions of the front and rear sides of said bottle project through and are engaged in said lower apertures to prevent lateral movement of the lower end of said bottle within said carton;

an inner bottom panel, hingedly connected to the second lower support panel, the upper surface of said inner bottom panel abutting the bottom of the bottle, said inner bottom panel including two locking flanges disposed adjacent the second lower support panel;

a first inner support panel hingedly attached to the inner bottom panel and disposed within said carton, the outer surface of said first inner support panel abutting the inner surface of the second lower support panel, said first inner support panel having a locking aperture whose configuration substantially corresponds to the aperture in said second lower support panel, said locking aperture being in register with the aperture in the second lower support panel;

a second inner support panel, hingedly attached to said first inner support panel and disposed within said carton, the inner surface of said second inner support panel abutting the bottle, while the opposed surface thereof abuts the inner surface of a main display panel; and a generally rectangular outer bottom panel hingedly connected along one side thereof to the first lower support panel and disposed directly beneath said inner bottom panel, said outer bottom panel including two generally rectangular flanges hingedly connected along the other opposed side edges thereof, with the hinge connection, between each said generally rectangular flange and the outer bottom panel, extending perpendicularly from the hinge line disposed between the first lower support panel and the outer bottom panel to a point intermediate the length of the outer bottom panel with the remaining distance along said perpendicular line defining a locking cut line, said rectangular flanges each being divided into sections by perforated lines, said sections including a generally triangular section at one edge of each flange adjacent the first lower support panel and a generally square section at the opposite edge of each flange adjacent the second lower support panel, said generally rectangular flanges being disposed upright and generally perpendicular relative to said outer bottom panel such that said locking flanges engage said rectangular flanges along the locking cut lines thereby locking the carton in the closed position, and wherein the ends of said rectangular flanges are bent inwardly towards the center of the carton, each flange having an arcuate configuration for aiding in maintaining the flange in an upright position for securely locking the carton.

12. A display carton as in claim 11 wherein each upper aperture in said inclined panels is of generally semi-elliptical configuration having a curved portion and a base line, with the base line being disposed adjacent said upper display panel, and wherein each lower aperture in said lower support panels is of generally semi-elliptical configuration having a curved portion and a base line, with the base line being disposed adjacent said inner bottom panel.

13. A display carton as in claim 11 wherein said upper and lower apertures are generally rectangular in configuration.

14. A blank made of paperboard for a hand locked display carton of generally triangular configuration adapted to be wrapped around an elongated bottle having at one end a cap, while the other end thereof is a closed base portion, where the width and length of the erected carton is greater than the width and length of the bottle, said carton providing an unobstructed view of two opposed sides of the bottle, comprising:

a generally rectangular outer bottom panel;

a first lower support panel hingedly attached to said outer bottom panel, said lower support panel having a first lower aperture;

a first main display panel hingedly attached to the first lower support panel;

a first inclined panel hingedly attached to the first main display panel, said inclined panel having a first upper aperture which corresponds to the configuration of the cap portion of said bottle;

a first upper display panel hingedly attached to the first inclined panel;

a second upper display panel hindgedly attached to the first upper display panel;

a second inclined panel hingedly attached to the second upper display panel, said inclined panel having a second upper aperture of substantially the same configuration as said first upper aperture in the first inclined panel;

a second main display panel hingedly attached to the second inclined panel;

a second lower support panel hingedly attached to the second main display panel, said second lower support panel having a second lower aperture substantially corresponding to the configuration of the first lower aperture of said first lower support panel; and an inner bottom panel hingedly attached to the second lower support panel, said inner bottom panel having locking flanges disposed adjacent said second lower support panel;

said outer bottom panel including two generally rectangular flanges hingedly connected along the other opposed side edges thereof, with the hinge connection between each generally rectangular flange and the outer bottom panel extending perpendicularly from the hinge line disposed between the first lower support panel and the outer bottom panel to a point intermediate the length of the outer bottom panel, with the remaining distance along said perpendicular line defining a locking cut line.

15. A blank as in claim 14 wherein said first and second upper apertures are of generally semi-elliptical configuration having a curved portion and a base line, with the base line being disposed adjacent said upper display panels; and wherein said first and second lower apertures are crescent shaped.

16. A blank as in claim 14 wherein said first and second upper apertures and said first and second lower apertures are generally rectangular in configuration.

17. A blank as in claim 14 further including a first inner support panel hingedly attached to the inner bottom panel, said first inner support panel having a locking lower aperture substantially corresponding to the configuration of the second lower aperture in the second lower support panel; and a second inner support panel hingedly attached to the inner support panel.

18. A blank as in claim 17 wherein said inner bottom panel includes a first arcuate flange disposed adjacent to said second lower support panel and a second arcuate flange disposed adjacent to said first inner support panel.

19. A blank as in claim 14 wherein said generally rectangular flanges of the outer bottom panel are divided into sections by perforated lines, said sections including a generally triangular section disposed at one edge of each rectangular flange, adjacent the first lower support panel and a generally square section disposed at the opposed edge of each rectangular flange, said square section further defined by said locking cut line.

20. A blank made of paperboard for a hand locked display carton of generally triangular configuration adapted to be wrapped around an elongated bottle, having at one end a cap, while the other end thereof is a closed base portion, where the width and length of the carton is greater than the width and length of the bottle, said carton providing an unobstructed view of two opposed sides of the bottle, comprising:

a generally rectangular outer bottom panel;

a first lower support panel hingedly attached to said outer bottom panel, said lower support panel having a first lower aperture;

a first main display panel hingedly attached to the first lower support panel;

a first inclined panel hingedly attached to the first main display panel, said inclined panel having a first upper aperture which substantially conforms to the configuration of the cap portion of said bottle;

a first upper display panel hingedly attached to the first inclined panel;

a second upper display panel hingedly attached to the first upper display panel;

a second inclined panel hingedly attached to the second upper display panel, said inclined panel having a second upper aperture of substantially the same configuration as said first upper aperture in the first inclined panel;

a second main display panel hingedly attached to the second inclined panel;

a second lower support panel hingedly attached to the second main display panel, said second lower support panel having a second lower aperture substantially corresponding to the configuration of the first lower aperture of the first lower support panel;

an inner bottom panel hingedly attached to the second lower support panel, said inner bottom panel having locking flanges disposed adjacent said second lower support panel;

a first inner support panel hingedly attached to the inner bottom panel, said first inner support panel having a locking lower aperture substantially corresponding to the configuration of the second lower aperture in the second lower support panel; and a second inner support panel hingedly attached to the inner support panel;

said outer bottom panel including two generally rectangular flanges hingedly connected along the other opposed side edges thereof, with the hinge connection between each generally rectangular flange and the outer bottom panel extending perpendicularly from the hinge line disposed between the first lower support panel and the outer bottom panel, to a point intermediate the length of the outer bottom panel, with the remaining distance along said perpendicular line defining a locking cut line, said generally rectangular flanges being divided into sections by perforated lines, said sections including a generally triangular section disposed at one edge of each flange and a generally square section disposed at the opposed edge of each flange, each said square section further defined by said locking cut line.

21. A blank as in claim 20 wherein said first and second upper apertures are of generally semi-elliptical configuration and have a curved portion and a base line, with the base line being disposed adjacent said upper display panels; and wherein said first and second lower apertures are crescent shaped.

22. A blank as in claim 20 wherein said first and second upper apertures and said first and second lower apertures are generally rectangular in configuration.

* * * * *